US006358107B1

(12) United States Patent
Roos

(10) Patent No.: US 6,358,107 B1
(45) **Date of Patent: *Mar. 19, 2002**

(54) MARINE JET DRIVE WITH IMPELLER-END AND ENGINE-END FLEXIBLE COUPLINGS

(76) Inventor: Paul W. Roos, 3580 Palladian Cir., Deerfield Beach, FL (US) 33442

( * ) Notice: Subject to any disclaimer, the term of this patent is extended or adjusted under 35 U.S.C. 154(b) by 0 days.

This patent is subject to a terminal disclaimer.

(21) Appl. No.: 09/540,135

(22) Filed: Mar. 31, 2000

Related U.S. Application Data

(60) Continuation of application No. 09/028,735, filed on Feb. 24, 1998, now Pat. No. 6,045,418, which is a division of application No. 08/456,188, filed on May 31, 1995, now Pat. No. 5,720,635, which is a division of application No. 07/699,336, filed on May 13, 1991, now Pat. No. 5,421,753.

(51) Int. Cl.[7] ..... B63H 23/34
(52) U.S. Cl. ..... 440/83; 440/38
(58) Field of Search ..... 60/221, 222; 440/38, 440/73, 83; 416/134 R

(56) References Cited

U.S. PATENT DOCUMENTS

| | | | | |
|---|---|---|---|---|
| 3,868,833 A | * | 3/1975 | Noe et al. | 440/38 |
| 4,474,561 A | * | 10/1984 | Haglund | 440/38 |
| 5,045,002 A | * | 9/1991 | Torneman et al. | 440/38 |
| 5,967,868 A | * | 10/1999 | Ito et al. | 440/111 |
| 6,045,418 A | * | 4/2000 | Roos | 440/38 |

* cited by examiner

*Primary Examiner*—Ed Swinehart
(74) *Attorney, Agent, or Firm*—Jansson, Shupe & Munger, Ltd

(57) ABSTRACT

A marine jet drive having a rotatable impeller, an impeller housing, an intake duct, a diffusor housing rearward of the impeller housing, an engine, and a unitary drive shaft extending from the engine to the impeller, and having a rear flexible coupling connecting the drive shaft to the impeller and a front flexible coupling connecting the drive shaft to the engine. Certain preferred embodiments include a shaft sleeve and rear seal assembly isolating the drive shaft from water and debris.

19 Claims, 3 Drawing Sheets

MARINE JET DRIVE WITH IMPELLER-END AND ENGINE-END FLEXIBLE COUPLINGS

RELATED APPLICATIONS

This is a continuation of Ser. No. 09/028,735, filed Feb. 24, 1998, now U.S. Pat. No. 6,045,418, which in turn is a divisional of Ser. No. 08/456,188, filed May 31, 1995, now U.S. Pat. No. 5,720,635, which in turn is a divisional of Ser. No. 07/699,336, filed May 13, 1991, now U.S. Pat. No. 5,421,753.

FIELD OF THE INVENTION

This invention is related generally to propulsion units for boats and, more particularly, to marine jet drives.

BACKGROUND OF THE INVENTION

Marine jet drives which propel vessels by means of water jets have long been known and used, and have certain significant advantages over the traditional external propeller units. A typical marine jet drive includes an engine-driven impeller which rotates inside an impeller housing. The impeller pumps water from below the vessel through an intake duct, and then pressurizes and expels the water through a diffusor housing and a nozzle behind the vessel.

Marine jet drives of the prior art have a number of problems and shortcomings, including as set forth below:

Design of marine jet drives involves many engineering considerations, such as: overall weight; tensile strength, compression, shear strength, elasticity, expansion and corrosivity of materials; operational tolerances; alignment considerations; and effective use of vessel space. Under the varying loads of operation of any marine jet drive, the propulsion system undergoes varying amounts of deformations. Engines, by virtue of the fact that they are typically mounted on resilient motor mounts, also produce movement which must be accommodated. Given these factors, it is necessary that marine jet drive systems accommodate such movements and deformations in one way or another.

Conventional jet drives need impeller tip clearances which are sufficient to allow for various deformations (including intake-duct deformation), engine-mount movement, shaft flexing and relative bearing movement under operational loads. In marine jet drive systems, the requirement of a water intake between the engine and the impeller typically means that the drive shaft, which extends across a portion of the intake duct, have considerable length. It is known that long unsupported spans of drive shafts require greater impeller-tip clearances than a shorter and/or supported spans of drive shafts. Larger impeller-tip clearances dramatically reduce the efficiency of jet drives.

The conventional jet drive, which has a drive shaft exposed to water in the intake duct, requires a shaft seal where the drive shaft passes through the transom (from the intake duct into the engine compartment within the vessel) in order to prevent ingress of water into the vessel. However, to avoid compromising such seals, drive shaft movement due to resilient motor mounts or deformation must be controlled. Drive shaft movement is typically restrained by a bearing and support structure between the engine and shaft seal assembly. Such bearing and seal assembly take up valuable vessel space by requiring that the engine be placed farther forward than would otherwise be necessary.

Use of metal structures has been considered favorable for reasons of strength and deformation resistance. However, use of metal parts in water, particularly sea water, produces electrolysis and corrosion, which have deleterious effects on longevity of conventional jet drives, on efficiency of operation, and in various other ways. Use of metal parts also contributes to high weight which has negative implications for performance.

Another prior art problem is the tendency of waterborne debris, particularly long-stranded debris, to become wrapped around exposed rotating drive shafts and impellers of conventional jet drives. This tends to reduce efficiency of operation, and can immobilize and endanger a vessel, particularly when its engine is turned off to clear the debris.

Another problem in various conventional marine jet drives is that they require frequent servicing and repair, and their disassembly is time-consuming.

OBJECTS OF THE INVENTION

It is accordingly a primary object of the present invention to provide a marine jet drive propulsion system that overcomes problems and shortcomings of the prior art, including those set forth above.

Another object of the invention is to provide an improved marine jet drive which readily accommodates a substantial degree of misalignment due to movements and deformations during system operation and a greater variation in engine placement.

Another object of the invention is to provide an improved marine jet drive which more effectively utilizes vessel space by allowing engine placement in a position which is farther aft.

Another object of the invention is to provide an improved marine jet drive in which the drive shaft is protected from exposure to water.

Another object of the invention is to provide an improved marine jet drive which is protected from entanglement of long-stranded debris with the drive shaft.

Another object of the invention is to provide an improved marine jet drive which protects the impeller from entanglement with long-stranded debris.

Another object of the invention is to provide an improved marine jet drive allowing a wider selection of materials, including drive-shaft materials.

Still another object of this invention is to provide an improved marine jet drive having a reduced unit weight.

Another object of the invention is to provide an improved marine jet drive which is easily and quickly serviced.

These and other objects of the invention will be apparent from the following descriptions and from the drawings.

SUMMARY OF THE INVENTION

This invention is an improved marine jet drive which overcomes various problems and shortcomings of the prior art including those referred to above. The marine jet drive of this invention is of the type which has forward and rearward ends, a rotatable impeller, an impeller housing around the impeller, a wall structure defining an intake duct forward of the impeller, a diffusor housing rearward of the impeller housing, an engine, and a unitary drive shaft extending from the engine to the impeller.

The improved marine jet drive of this invention includes a rear flexible coupling flexibly connecting the drive shaft to the impeller, and a front flexible coupling flexibly connecting the drive shaft to the engine. In preferred embodiments, the front flexible coupling is inside the vessel and directly coupled to the engine.

In preferred embodiments, the marine jet drive includes a bearing support structure which is disposed inside the diffusor housing and rotatively supports the impeller, and the rear flexible coupling is disposed within such bearing support structure. The bearing support structure is preferably rigidly attached to the diffusor housing by a plurality of radially disposed stator vanes.

In certain embodiments, the rear flexible coupling includes a drive shaft tube having at least one key for connection to the impeller, and the drive shaft is flexibly connected to the drive shaft tube by the rear flexible coupling.

Highly preferred embodiments include a shaft sleeve secured with respect to the duct-forming wall structure and having front and rear sleeve ends, and a seal assembly at the rear end of the shaft sleeve, such that the drive shaft is isolated from water and debris. In such highly preferred embodiments, the seal assembly preferably includes a seal cartridge between the shaft sleeve and the impeller.

In certain of such highly preferred embodiments, the impeller includes an impeller hub and a rotating outer housing member secured with respect to the impeller hub, and the seal assembly includes such outer housing member and the seal cartridge which is within the outer housing member. The seal cartridge preferably includes: a rotating seal element; a static seal element contacting the rotating seal element, the rotating and static seal elements have sealing faces engaged with one another; an inner housing member adjacent to and enclosing a portion of the static seal element and in releaseable sealing engagement with the shaft sleeve; and a spring extending between the inner housing member and the static seal element to urge the static seal element against the rotating seal element.

In highly preferred embodiments of the type just described, the inner housing member is retained within the outer housing member by an annular-groove-and-pin arrangement which allows free rotation of the outer housing member about the inner housing member but prevents the inner housing member from being axially separated from the outer housing member, thus retaining the seal cartridge in position during installation or disassembly of the drive unit from the vessel. Such annular-groove-and-pin arrangement most preferably involves the inner housing member having an outer surface with an annular groove on it, and at least one (and preferably more than one) retaining pin through the outer housing member and extending part way into the annular groove. The retaining pin or pins can be withdrawn from the annular groove to allow removal of the seal cartridge from the outer housing member.

In certain of the preferred embodiments having a shaft sleeve and rear seal to isolate the drive shaft, the shaft sleeve has a rear recess and the inner housing member referred to above has a forward portion which is removably inserted into the rear recess, the forward portion having a compressible seal engaging the shaft sleeve within the rear recess. This serves to provide sealing engagement while permitting release of the seal cartridge when an axial pull is applied to quickly and easily separate the inner housing from the shaft sleeve.

In certain of the preferred embodiments having a shaft sleeve and rear seal to isolate the drive shaft, the above-mentioned rotating outer housing member in which the seal cartridge is located has one or more radially-disposed ports therethrough which are adjacent to the static seal element. This allows the centrifugal action caused by rotation of the outer housing member to cause water to be drawn past the static seal element and out through the ports to facilitate cooling of the sealing surfaces. It is most preferred that the static seal element include cooling fins to facilitate heat transfer from the seal elements to the flowing water. This helps to keep the interfacing rotating and static seal elements from overheating.

Certain of the preferred embodiments that have a shaft sleeve and rear seal to isolate the drive shaft also include a debris-cutting device which serves to sever and reduce long-stranded incoming debris in order to prevent deleterious interactions with the impeller. The debris-cutting device includes one or more rotating blades which are secured to the outer housing member and at least one fixed blade secured with respect to the shaft sleeve in position such that the rotating blade or blades rotate past the fixed blade(s) to sever debris.

The marine jet drive dual-flexible-coupling arrangement of this invention provides important advantages. Significantly, such improved marine jet drives are particularly excellent in their accommodation of substantial deformation and movements which occur in jet-drive operation, allowing a jet drive to accommodate a variety of vessels and engines. The invention also facilitates assembly and disassembly of the drive unit with respect to the engine.

The preferred embodiments which also include a shaft sleeve and rearward seal assembly to isolate the drive shaft from water and debris provide various further advantages. For example, a wider choice of drive-shaft sizes and materials is allowed, and this facilitates weight reduction and enhances performance. In addition, isolation of the drive shaft from the water eliminates any entanglement of debris with the drive shaft, and all the related problems. Versions including a debris cutter further protect the impeller from such debris.

DESCRIPTION OF PREFERRED EMBODIMENTS

Figure 1:
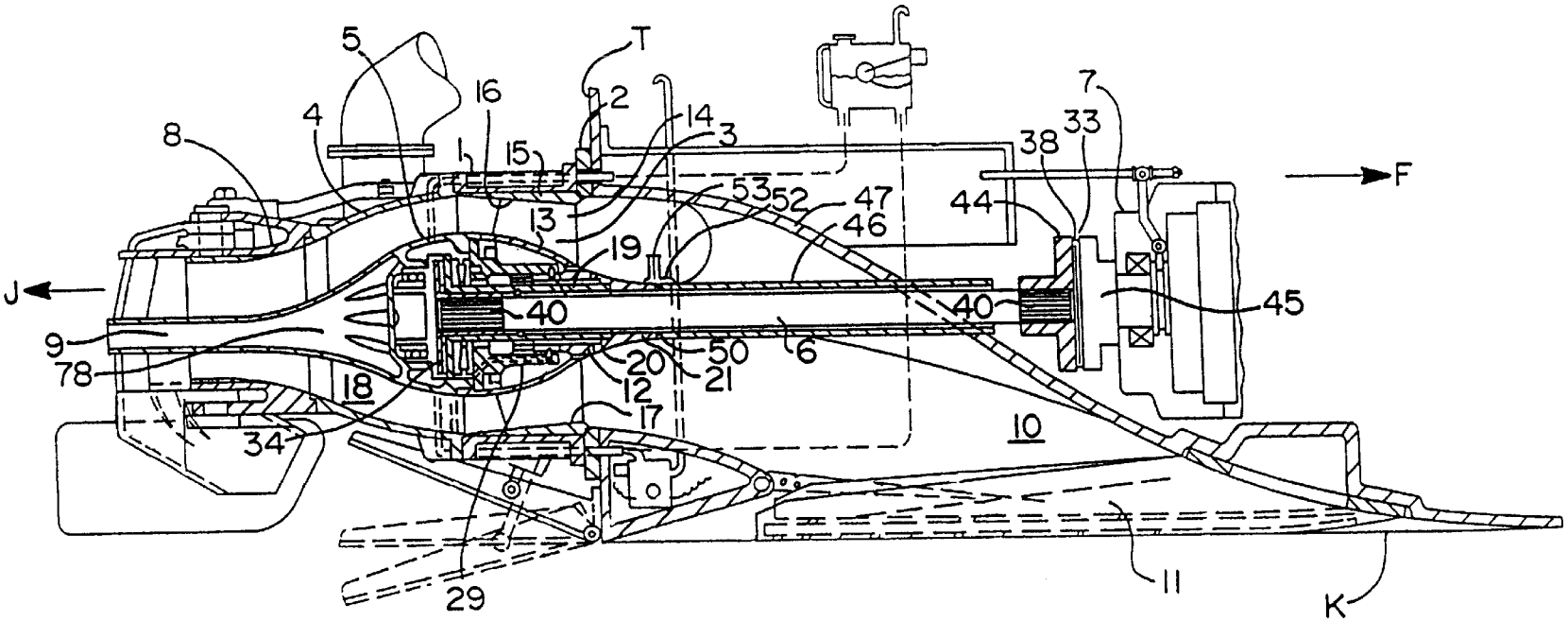
FIG. 1 is a cross-sectional view, taken along the drive-train centerline, of a marine jet drive in accordance with a preferred embodiment of this invention, showing its interior construction.
Figure 2:
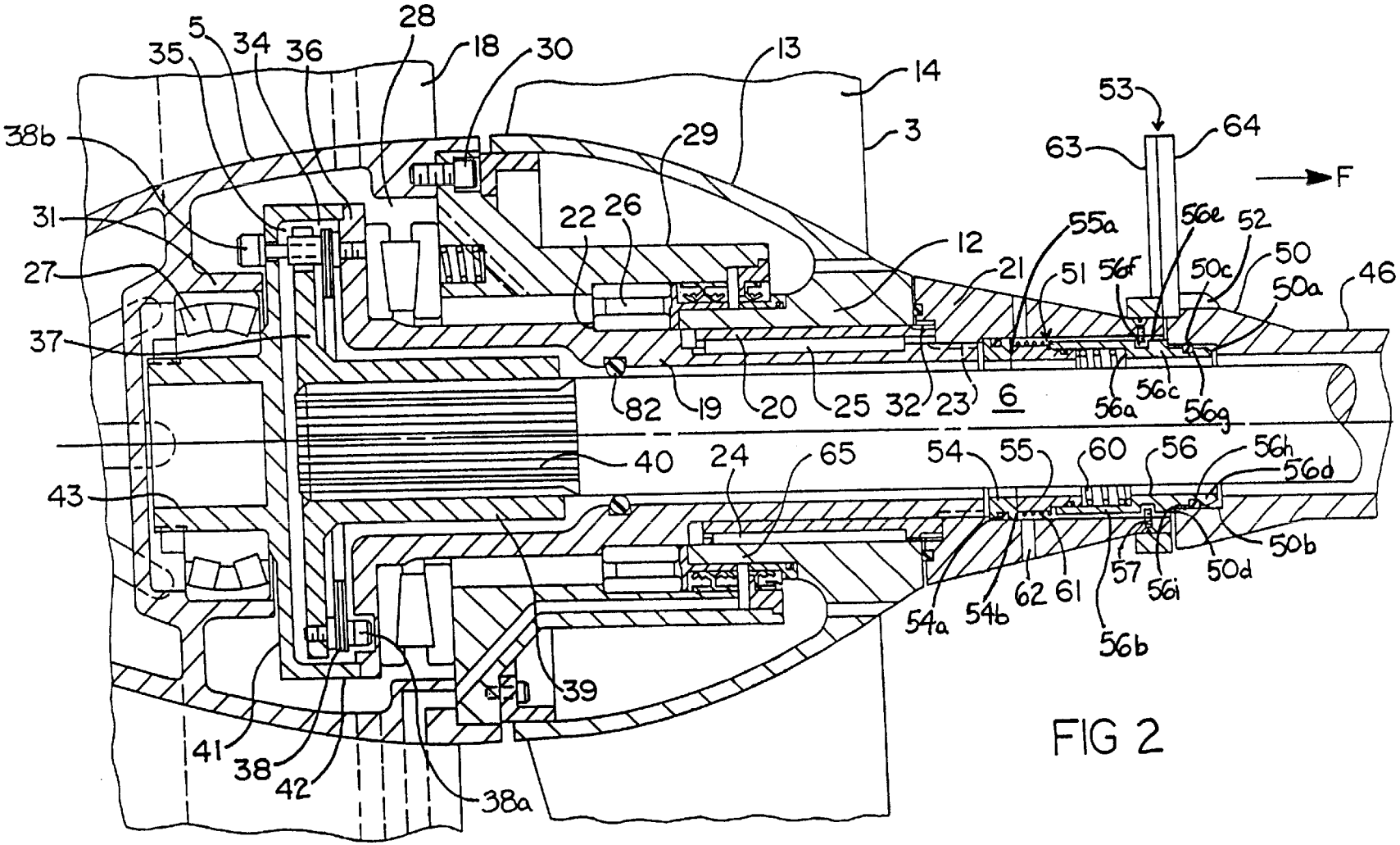
FIG. 2 is an enlarged fragmentary view of FIG. 1, showing addditional details.
Figure 3:
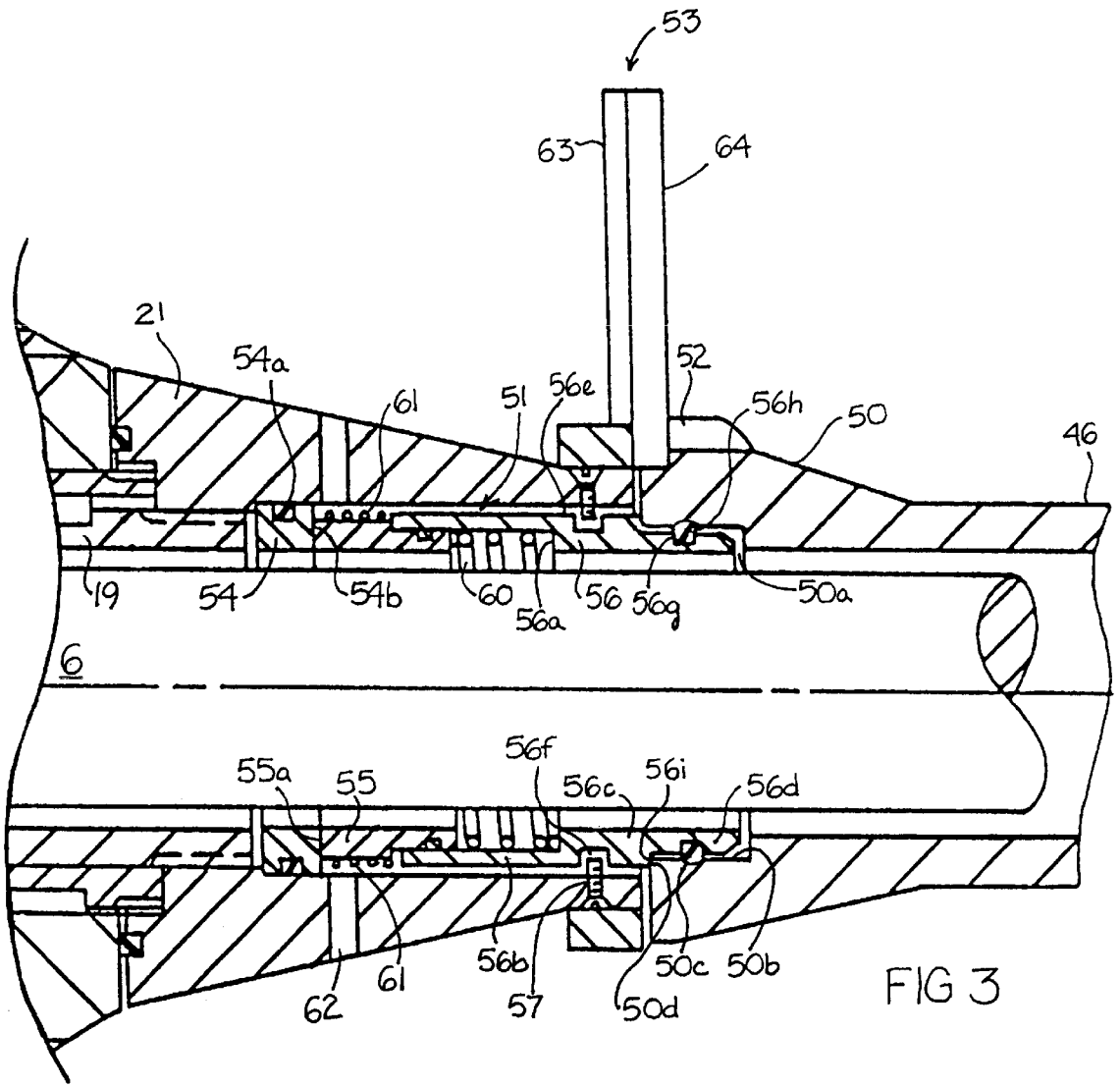
FIG. 3 is a further enlarged fragmentary view of FIG. 2.

FIGS. 1–3 illustrate a marine jet drive according to this invention, located generally at the transom T of a vessel and generally above the keel line K, the direction of the jet stream J being rearward to propel the vessel forward as indicated by arrow F.

The jet drive includes the following general elements: an impeller housing 1 attached to an intake flange 2; a rotatable impeller 3 disposed in impeller housing 1, its axis of rotation being aligned generally with keel line K; a diffusor housing 4 connected to impeller housing 1 and forming a water outlet port; a bearing support structure 5 disposed inside diffusor housing 4; a drive shaft 6 rotatively connecting impeller 3 with engine 7; a nozzle housing 8 attached to the diffusor housing 4 and forming a rearward-facing nozzle for jet stream J; an engine exhaust discharge tube 9 attached to bearing support structure 5; a water intake duct 10 ahead of impeller housing 1 and attached to the vessel; and an intake grid 11 disposed in intake duct 10.

Impeller 3 includes, among other things, an impeller hub 12, an impeller bell 13 and a plurality of impeller blades 14 radially extending from the impeller bell 13 and terminating in blade tips 16. A circular wear-ring insert 15 is inserted coaxially, snugly fitting the inside of impeller housing 1 such that impeller blade tips 16 extend to within close proximity of the inner surface 17 of wear-ring insert 15. Blades 14 are advantageously positioned to promote fluid flow from intake duct 10 to diffusor housing 4 when impeller 3 rotates. Wear-rings of varying sizes and shapes may be selected depending on desired performance requirements of the jet-drive application. Such variations are possible without affecting the size and shape of impeller housing 1 or diffusor housing 4.

Diffusor housing 4 supports bearing support structure 5 by a plurality of stator vanes 18 which are radially disposed between diffusor housing 4 and bearing support structure 5, as seen in FIG. 1. Stator vanes 18 are advantageously positioned to recover the rotational energy imparted by impeller 3.

Impeller 3 is supported on a shaft tube 19 as shown in FIG. 2. Impeller hub 12 accepts a split tapered bushing 20 in a tapered recess, and split tapered bushing 20 in turn fits over shaft tube 19. An impeller lock nut (or "rotating outer housing member") 21 is secured with respect to impeller hub 12 by threaded connection (see threads 23) onto shaft tube 19, thereby wedging impeller hub 12 against split tapered bushing 20 and shaft tube 19. Impeller lock nut 21, which is a part of impeller 3, also serves as the aforementioned rotating outer housing member of a seal assembly. The seal assembly also includes a seal cartridge 51, hereafter described. An abutment 22 on shaft tube 19 prevents impeller hub 12 from moving rearward as impeller lock nut 21 is tightened. A thread 32 on tapered bushing 20, permits the application of releasing force by means of a release nut (not shown) against impeller hub 12 to release tapered bushing 20 and free impeller hub 12 from shaft tube 19, to provide a quick installation and release method for installing and removing impeller 3. Impeller torque is transmitted via two or more keys, including at least one outer key 24 between impeller hub 12 and tapered bushing 20 and at least one inner key 25 between tapered bushing 20 and shaft tube 19. Tapered bushing 20 is oriented to cause the thrust in forward direction F which is generated by the rotation of impeller 3 to force impeller 3 more tightly onto tapered bushing 20.

Shaft tube 19 supports impeller 3, as shown in FIGS. 1 and 2, and is suspended by a forward bearing 26, a rear bearing 27, and a thrust bearing 28. Rear bearing 27 and thrust bearing 28 provide axial lock-up of shaft tube 19. The thrust force of impeller 3 is transmitted via tapered bushing 20 to shaft tube 19 by thrust bearing 28 to a bearing support 29 that also supports forward bearing 26. Bearing support 29 is affixed to bearing support structure 5 with a plurality of fasteners 30 at the interface between bearing support structure 5 and bearing support 29. Rear bearing 27 is supported directly by a recess 31 in bearing support structure 5. This support method fixes impeller 3 rigidly but rotatively in relation to impeller housing 1 and allows for closer tolerances between impeller tips 16 and wear-ring insert inner surface 17, improving the efficiency of the jet drive.

Drive shaft 6 is coupled at its forward end to engine 7 by means of a front flexible coupling 33 inside the vessel. Drive shaft 6 is coupled at its rearward end to shaft tube 19 by means of a rear flexible coupling 34 inside a cavity 35.

At the rearward end, shaft tube 19 is split perpendicularly (to the axis of rotation) at the largest diameter of cavity 35 to facilitate installation of rear flexible coupling 34. The forward wall of cavity 35 is formed by a flange 36 of shaft tube 19. Flange 36 transmits the thrust load to thrust bearing 28 and serves as the driven part of flexible coupling 34. A driving flange 37 of coupling 34 is suspended in cavity 35 via a flexible element 38. Driving flange 37 is connected to flexible element 38 by a plurality of fasteners 38*a*. Driving flange 37 has a hub 39 that is provided with a spline connection 40 which engages drive shaft 6. A flexible seal 82 is placed between shaft tube 19 and drive shaft 6 to prevent water entry into coupling cavity 35, while drive shaft 6 may move as permitted by coupling 34. Coupling cavity 35 is further formed by a rear flange 41 with a forward protruding rim 42 engaging forward flange 36 of shaft tube 19 with a close tolerance register to maintain alignment of rear bearing 27 with forward bearing 26 and thrust bearing 28. Rear flange 41 is connected to flexible element 38 and shaft tube 19 by a plurality of fasteners 38*b*. At the other side of rear flange 41 is a hub 43 supporting rear bearing 27.

At the forward end of drive shaft 6, flexible coupling 33 is similar to rear flexible coupling 34, with the driven flange 44 being attached to drive shaft 6 with a spline connection 40 similar to the one in hub 39. A driving flange 45 is attached to the output shaft of engine 7, which is placed on resilient engine supports (not shown) to limit transmission of engine vibrations to the vessel.

Misalignment due to various deformations and engine movements during operation are absorbed by the combination of front and rear flexible couplings 33 and 34 and front and rear spline connections 40. All such misalignments are absorbed at the ends of drive shaft 6 via flexible couplings 33 and 34; no further components are necessary to accommodate misalignment. Spline connections 40 provide torque transmission and permit axial movement between each of flanges 37 and 44 and drive shaft 6. Quick release of drive shaft 6 from flexible couplings 33 and 34 is achieved by simple extraction of drive shaft 6 from flanges 37 and 44.

The marine jet drive further includes a shaft sleeve 46 in intake duct 10. Shaft sleeve 46 encloses drive shaft 6 and is supported by an upper wall 47 of intake duct 10. Sleeve 46 isolates rotating drive shaft 6 from water and debris that might otherwise be ingested by intake duct 10 and get wrapped around drive shaft 6. Additionally, as no water from intake duct 10 comes in contact with drive shaft 6 by virtue of shaft sleeve 46 and seal cartridge 51, which is located between impeller 3 and shaft sleeve 46, drive shaft 6 may be made of materials (alloys or composites) chosen purely for their strength (or light weight) and not for corrosion protection. Higher strength materials permit smaller and lighter drive shafts. The inner bore of shaft sleeve 46 may be tapered, thereby providing a larger bore diameter toward the forward end of drive shaft 6 to allow for increased drive shaft articulation near front flexible coupling 33.

The seal assembly, including rotating outer housing member (or "impeller locking nut") 21 and seal cartridge 51, seals shaft sleeve 46 with respect to impeller 3. Such seal assembly prevents water in intake duct 10 from entering shaft sleeve 46 between the forward end of rotating impeller hub 12, where rotating outer housing member 21 is located, and the end 50 of fixed shaft sleeve 46. Thus, shaft sleeve 46 and such seal assembly serve together to keep drive shaft 6 dry and isolated from the water and any debris. Given that shaft sleeve 46 is open to the interior of the vessel, the seal assembly serves to prevent water not only from entering shaft sleeve 46, but consequently also from entering the vessel.

Seal cartridge 51, which is best illustrated in FIG. 3, includes several parts housed within rotating outer housing member 21 of the seal assembly. These include a rotating seal element 54, a static seal element 55, an inner housing member (or "retaining member") 56, a coil spring 60, and certain other elements hereafter described. Rotating seal element 54 is an annular member spaced from and encircling drive shaft 6 in a position inside outer housing member (or "impeller locking nut") 21 and forward of shaft tube 19. Rotating seal element 54 is sealingly secured with respect to outer housing member 21 (with which seal element 54 rotates) by an O-ring 54*a* (or other suitable sealing and securing means) in compression therebetween.

Static seal element 55 is an annular member immediately forward of rotating seal element 54. Static seal element 55 has a rear sealing face 55*a* which is in compression sealing engagement with a forward sealing face 54*b* of rotating seal element 54. Such compression sealing engagement is by virtue of spring 60 which extends axially between static seal element 55 and a rearward-facing inner ledge 56*a* of inner housing member 56. Inner housing member 56 also includes a rearward-extending cup portion 56*b* which contains spring 60.

Inner housing member 56 also includes a main portion 56*c* which is forward of cup portion 56*b*, and a forward portion 56*d* which is forward of main portion 56*c*. Main portion 56*c* has an outer surface 56*e* which forms an annular groove 56*f*.

Forward portion 56*d* is received within a rear recess 50*a* of end 50 of shaft sleeve 46. Forward portion 56*d* of seal cartridge 51 includes a groove 56*g* on its outer surface which holds an O-ring 56*h* (or other suitable sealing and securing means) in compression fit within rear recess 50*a*. More specifically, rear recess 50*a* is bounded by annular inner wall 50*b* which includes a shallow annular indent 50*c* on which O-ring 56*h* is located, in compression against inner housing member 56.

Retaining pins 57 extend radially through outer housing member (or "impeller locking nut") 21 such that their ends extend partially into annular groove 56*f* This serves to hold seal cartridge 51 axially in place within outer housing member 21 during disassembly of the jet drive unit; however, when the jet drive is assembled and in operation, the ends of retaining pins 57 move freely around groove 56*f* as impeller 3 and outer housing member 21 rotate.

Main portion 56*c* of inner housing member 56 has an annular forward abutment surface 56*i* which engages the rear surface 50*d* of sleeve end 50. This engagement defines the relative axial positions of seal cartridge 51 with respect to shaft sleeve 46, and serves to hold seal cartridge 51 in position relative to outer housing member 21 such that retaining pins 57 are aligned with groove 56*f*

Spring 60 urges rear sealing face 55*a* of static seal element 55 against and in sealing engagement with forward sealing face 54*b* of rotating seal element 54. The heat generated by friction between sealing faces 55*a* and 54*b* are conducted through static seal element 55 to cooling fins 61 which extend radially on the outer surface of static seal element 55. Water from intake duct 10 is pulled in from the gap between outer housing member 21 and sleeve end 50, then is pulled past cooling fins 61, and exits by means of centrifugal force through a plurality of radially disposed holes 62 in outer housing member 21. Rotational lock-up is provided between static seal element 55, inner housing member 56 and sleeve end 50 to prevent the components from turning with rotating seal element 54.

As best shown in FIGS. 2 and 3, a cutting device 53 is provided which includes one or more rotating blades 63 mounted on the rotating outer housing member (or "impeller lock nut") 21, and one or more stationary blades 64 which are mounted on shaft sleeve 46 and are further secured from rotating by one or more back stops 52. Cutting device 53 serves to cut any long-stranded debris that has passed through intake grid 11 to prevent such debris from wrapping itself around impeller 3 and causing cavitation and/or imbalance.

While the principles of this invention have been described in connection with specific embodiments, it should be understood clearly that these descriptions are made only by way of example and are not intended to limit the scope of the invention.

I claim:

1. In a vessel-propelling marine jet drive having forward and rearward ends, a rotatable impeller, an impeller housing around the impeller, an intake duct forward of the impeller housing, a diffusor housing rearward of the impeller housing, an engine, and a drive shaft extending from the engine to the impeller, the improvement comprising:

a rear flexible coupling flexibly connecting the drive shaft to the impeller;

a front flexible coupling flexibly connecting the drive shaft to the engine; and the drive shaft being substantially unsupported between the front and rear flexible couplings.

2. The marine jet drive of claim 1 wherein the front flexible coupling is inside the vessel and directly coupled to the engine.

3. The marine jet drive of claim 1 wherein the drive shaft is a unitary shaft.

4. In a vessel-propelling marine jet drive having forward and rearward ends, a rotatable impeller, an impeller housing around the impeller, an intake duct forward of the impeller housing, a diffusor housing rearward of the impeller housing, an engine, and a drive shaft extending from the engine to the impeller, the improvement comprising:

a rear flexible coupling flexibly connecting the drive shaft to the impeller;

a front flexible coupling flexibly connecting the drive shaft to the engine, said front flexible coupling being inside the vessel and directly coupled to the engine; and a bearing support structure disposed inside the diffusor housing and rotatively supporting the impeller.

5. The marine jet drive of claim 4 wherein the bearing support structure is rigidly attached to the diffusor housing by a plurality of radially disposed stator vanes.

6. The marine jet drive of claim 4 wherein:

the rear flexible coupling includes a drive shaft tube having at least one key for connection to the impeller; and the drive shaft is flexibly connected to the drive shaft tube by the rear flexible coupling.

7. The marine jet drive of claim 6 wherein the bearing support structure is rigidly attached to the diffusor housing by a plurality of radially disposed stator vanes.

8. The marine jet drive of claim 4 wherein the rear flexible coupling is disposed within the bearing support structure.

9. The marine jet drive of claim 4 wherein the drive shaft is a unitary shaft.

10. In a vessel-propelling marine jet drive having forward and rearward ends, a rotatable impeller, an impeller housing around the impeller, an intake duct forward of the impeller housing, a diffusor housing rearward of the impeller housing, an engine, and a drive shaft extending from the engine to the impeller, the improvement comprising:

a rear flexible coupling flexibly connecting the drive shaft to the impeller;

a front flexible coupling flexibly connecting the drive shaft to the engine;

a wall structure forward of the impeller and defining the intake duct, the drive shaft extending across a portion of the intake duct;

a shaft sleeve secured with respect to the wall structure and having front and rear ends; and a seal assembly at the rear end of the shaft sleeve, whereby the drive shaft is isolated from water and debris.

11. The marine jet drive of claim 10 wherein the seal assembly includes a seal cartridge between the shaft sleeve and the impeller.

12. The marine jet drive of claim 11 wherein the impeller includes an impeller hub and a rotating outer housing member secured with respect thereto, the seal assembly includes the outer housing member and the seal cartridge, and the seal cartridge includes:

a rotating seal element;

a static seal element contacting the rotating seal element, the rotating and static seal elements have sealing faces engaged with one another;

an inner housing member adjacent to and enclosing a portion of the static seal element and in releaseable sealing engagement with the shaft sleeve; and a spring between the inner housing member and the static seal element to urge the static seal element against the rotating seal element.

13. The marine jet drive of claim 12 wherein the inner housing member is retained within the outer housing member by an annular-groove-and-pin arrangement which allows free rotation of the outer housing member about the inner housing member but prevents the inner housing member from being axially separated from the outer housing member.

14. The marine jet drive of claim 13 wherein the annular-groove-and-pin arrangement comprises:

the inner housing member having an outer surface with an annular groove thereon; and at least one retaining pin through the outer housing member and extending into the annular groove, such retaining pin(s) being withdrawable from the annular groove to allow removal of the seal cartridge from the outer housing member.

15. The marine jet drive of claim 12 wherein:

the shaft sleeve has a rear recess;

the inner housing member has a forward portion removably inserted into the rear recess; and the forward portion has a compressible seal engaging the shaft sleeve within the rear recess, thereby providing sealing engagement while permitting release of the seal cartridge when axial pull is applied, to separate the inner housing from the shaft sleeve.

16. The marine jet drive of claim 12 wherein the outer housing member has at least one radially-disposed port therethrough adjacent to the static seal element, whereby centrifugal action upon rotation of the outer housing member causes water to be drawn past the static seal element and out through the port(s) to facilitate cooling of the sealing surfaces.

17. The marine jet drive of claim 16 wherein the static seal element includes cooling fins to facilitate heat transfer from the seal elements to the flowing water.

18. The marine jet drive of claim 12 further including a debris-cutting device comprising:

at least one rotating blade secured to the outer housing member; and at least one fixed blade secured with respect to the shaft sleeve in position such that the rotating blade rotates past the fixed blade(s) to sever debris.

19. The marine jet drive of claim 10 wherein the drive shaft is a unitary shaft.

* * * * *